US007195042B1

(12) United States Patent
Hawie et al.

(10) Patent No.: US 7,195,042 B1
(45) Date of Patent: Mar. 27, 2007

(54) TESTING RIG AND METHOD FOR A FUEL NOZZLE ASSEMBLY

(75) Inventors: Eduardo Hawie, Woodbridge (CA); Jason Fish, Brampton (CA); Jian-Ming Zhou, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 11/412,902

(22) Filed: Apr. 28, 2006

(51) Int. Cl.
*B65B 1/04* (2006.01)

(52) U.S. Cl. ..... 141/83; 701/100; 73/119 A

(58) Field of Classification Search ..... 141/83, 141/94; 73/119 A; 701/100; 239/74, 71, 239/211
See application file for complete search history.

(56) References Cited

U.S. PATENT DOCUMENTS

| | | | |
|---|---|---|---|
| 3,221,546 | A | 12/1965 | Heath |
| 3,478,580 | A | 11/1969 | Siemietkowski et al. |
| 3,745,818 | A | 7/1973 | Gaenzler |
| 3,930,775 | A | 1/1976 | Fisher et al. |
| 4,001,359 | A | 1/1977 | Fisher et al. |
| 4,088,012 | A | 5/1978 | Emerson |
| 4,428,228 | A | 1/1984 | Banzhaf et al. |
| 4,559,815 | A | 12/1985 | Needham |
| 4,712,421 | A | 12/1987 | Young |
| 4,788,858 | A | 12/1988 | Liebermann |
| 5,571,959 | A | 11/1996 | Griggs |
| 5,689,066 | A | 11/1997 | Stevenson |
| 6,234,002 | B1 | 5/2001 | Sisney et al. |
| 6,668,615 | B2 | 12/2003 | Bodenmueller et al. |
| 6,672,145 | B2 | 1/2004 | Mitchell et al. |
| 6,782,317 | B2 | 8/2004 | Mitchell et al. |
| 2004/0089052 | A1 | 5/2004 | Bodenmueller et al. |
| 2005/0087004 | A1 | 4/2005 | Brock |

*Primary Examiner*—Steven O. Douglas
(74) *Attorney, Agent, or Firm*—Ogilvy Renault LLP

(57) ABSTRACT

A method for testing a fuel nozzle assembly including blocking all but a selected number of the fuel nozzles with a flow impeding assembly and moving part of a rig to align the selected number of the fuel nozzles with at least one flow measurement apparatus.

23 Claims, 5 Drawing Sheets

TESTING RIG AND METHOD FOR A FUEL NOZZLE ASSEMBLY

TECHNICAL FIELD

The invention relates generally to testing equipment for fuel nozzle assemblies and, more particularly, to an improved rig for testing a fuel nozzle assembly having a plurality of fuel nozzles.

BACKGROUND OF THE ART

A conventional method of testing a fuel nozzle assembly includes containing the fuel nozzle assembly in a box where air and fuel is provided to the assembly, and collecting fuel exiting from the fuel nozzles in a flow measurement apparatus or viewing the exiting fuel through a transparent wall to observe flow characteristics thereof. However, the fuel nozzles are generally all operated at once, making it difficult to isolate and identify the flow characteristics of a single fuel nozzle independently of the others.

Accordingly, improvements are desirable.

SUMMARY OF THE INVENTION

It is therefore an object of this invention to provide an improved testing rig for a fuel nozzle assembly.

In one aspect, the present invention provides a method for testing a fuel nozzle assembly including a plurality of spaced apart fuel nozzles in communication with a manifold, the method comprising: supporting the fuel nozzle assembly with a rig; blocking all but a selected number of the fuel nozzles with a flow impeding assembly; moving part of the rig to align the selected number of the fuel nozzles with at least one flow measurement apparatus; and operating the fuel nozzle assembly and determining at least one spray characteristic of the selected number of the fuel nozzles using the flow measurement apparatus.

In another aspect, the present invention provides a fuel nozzle assembly testing rig for testing a fuel nozzle assembly comprising: a receiving member defining an enclosure and having a wall with an array of spaced apart nozzle-receiving holes defined therethrough in communication with the enclosure; at least one fluid conduit in communication with the enclosure and adapted to be connected in fluid flow communication with the fuel nozzle assembly; and a flow impeding assembly detachably connected to the receiving member in a selected one of a plurality of configurations, each of the configurations leaving at least one of the nozzle-receiving holes unobstructed while blocking the remaining nozzle-receiving holes.

In a further aspect, the present invention provides a fuel nozzle assembly testing rig for testing a fuel nozzle assembly including a manifold and a series of regularly spaced apart fuel nozzles connected thereto, the testing rig comprising: a receiving member supporting and moving the fuel nozzle assembly to successively align each of the fuel nozzles with a flow measurement apparatus; at least one fluid conduit in operating engagement with the fuel nozzle assembly for providing a testing fluid thereto; and means for blocking all but at least one unobstructed fuel nozzle, the means for blocking being configurable in a selected one of a plurality of configurations, each of the configurations providing different fuel nozzles as the at least one unobstructed fuel nozzle.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
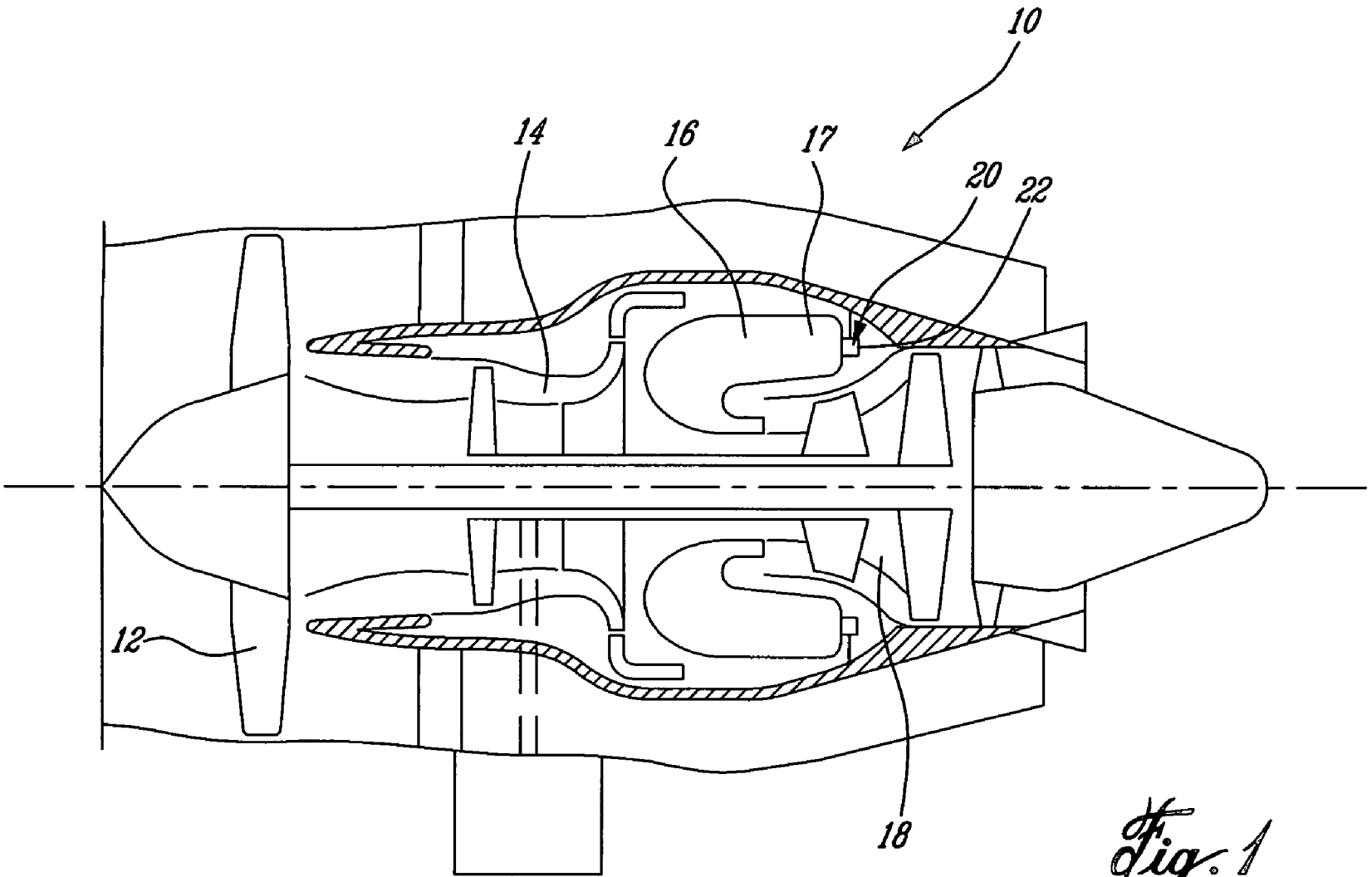
FIG. 1 is a schematic cross-sectional view of a gas turbine engine.

FIG. 1 illustrates a gas turbine engine 10 generally comprising, in serial flow communication, a fan 12 through which ambient air is propelled, a multistage compressor section 14 for pressurizing the air, a combustion section 16 in which the compressed air is mixed with fuel atomized into a combustion chamber 17 by a fuel injection system comprising a fuel nozzle assembly 20, the mixture being subsequently ignited for generating hot combustion gases before passing through a turbine section 18 for extracting energy from the combustion gases.

Figure 2:
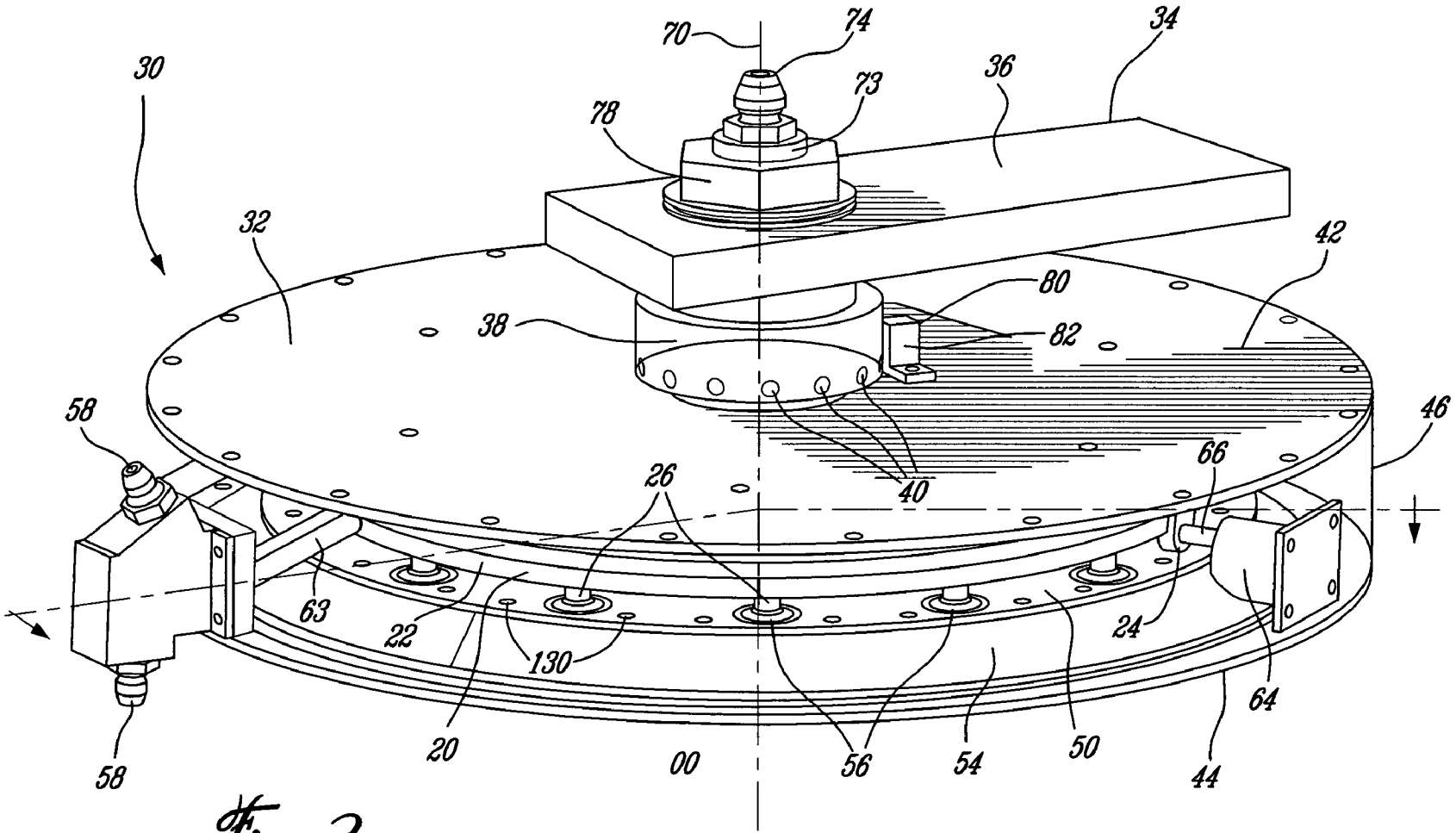
FIG. 2 is a perspective view of a testing rig according to a particular embodiment of the present invention, shown with a fuel nozzle assembly of the engine of FIG. 1 contained therein and with a side wall thereof omitted for improved clarity.
Figure 3:
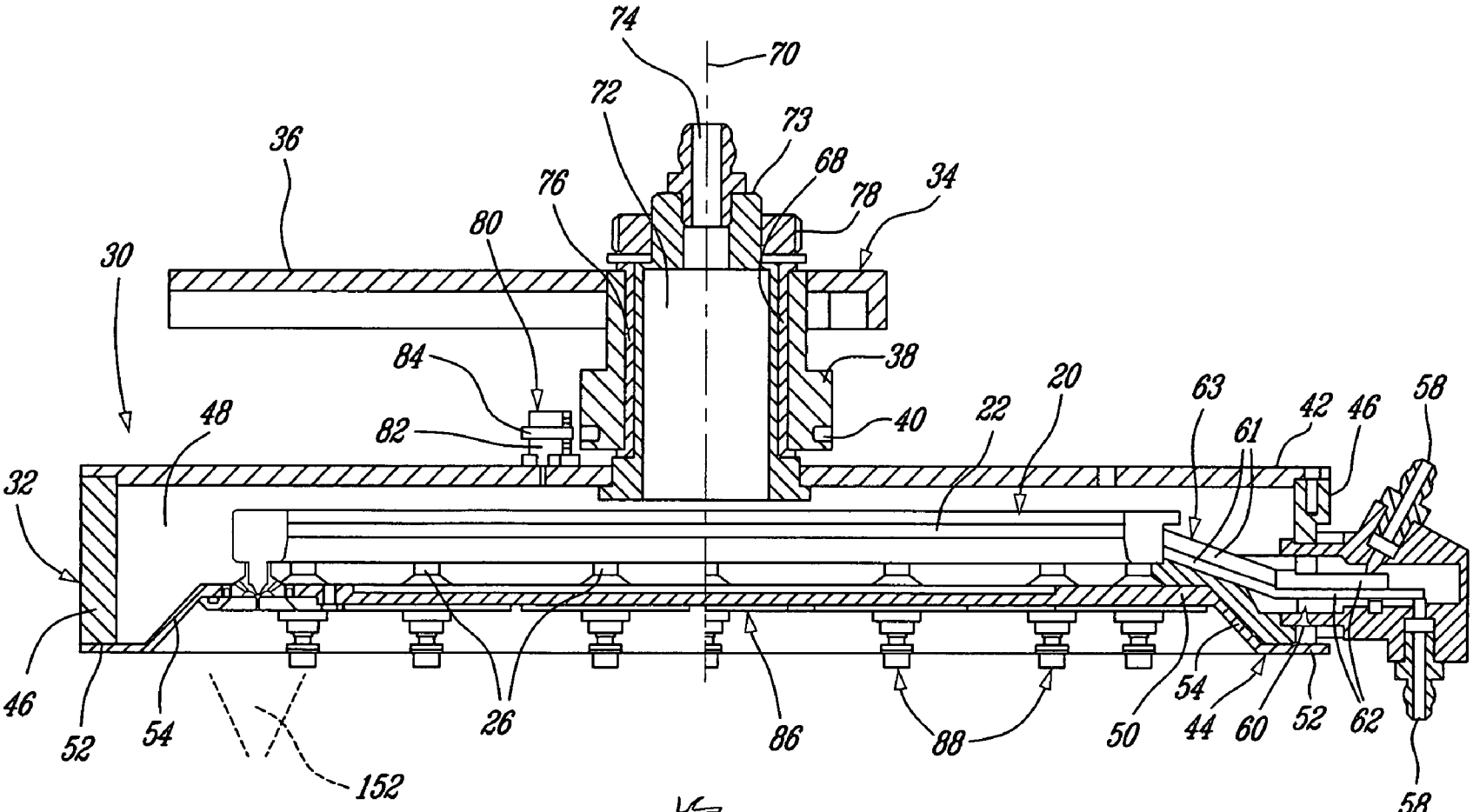
FIG. 3 is a cross-sectional view taken along line 3—3 in FIG. 2.

Referring to FIGS. 2–3, the fuel nozzle assembly 20 of the gas turbine engine 10 is shown removed from the engine 10 and received in a testing rig 30 for flow measurement testing. The fuel nozzle assembly 20 comprises an annular fuel manifold 22 which in use within the engine 10 is generally disposed adjacent the combustion chamber 17 (see FIG. 1), and includes several integral attachment lugs 24 (only one of which being visible in FIG. 2) for fixing the manifold to an appropriate support structure of the engine 10. The fuel nozzle assembly 20 also comprises a plurality of regularly spaced apart fuel nozzles 26 in communication with the manifold 22, each fuel nozzle 26 includes a spray tip 28 (see FIGS. 4–5) atomizing the fuel for combustion.

Referring to FIGS. 2–3, the testing rig 30 generally comprises a receiving member, which in the embodiment shown is a cylindrical air box 32, rotationally connected to a support 34. The support 34 includes a horizontal arm 36 extending from any type of adequate support structure, such as for example a base supported on a floor surface (not shown). The support 34 also includes a cylindrical sleeve 38 extending downwardly from the arm 36 in a fixed manner relative thereto. The sleeve 38 includes an array of regularly spaced apart pin holes 40 defined about an outer circumference thereof, the purpose of which will be further detailed below.

Figure 4:
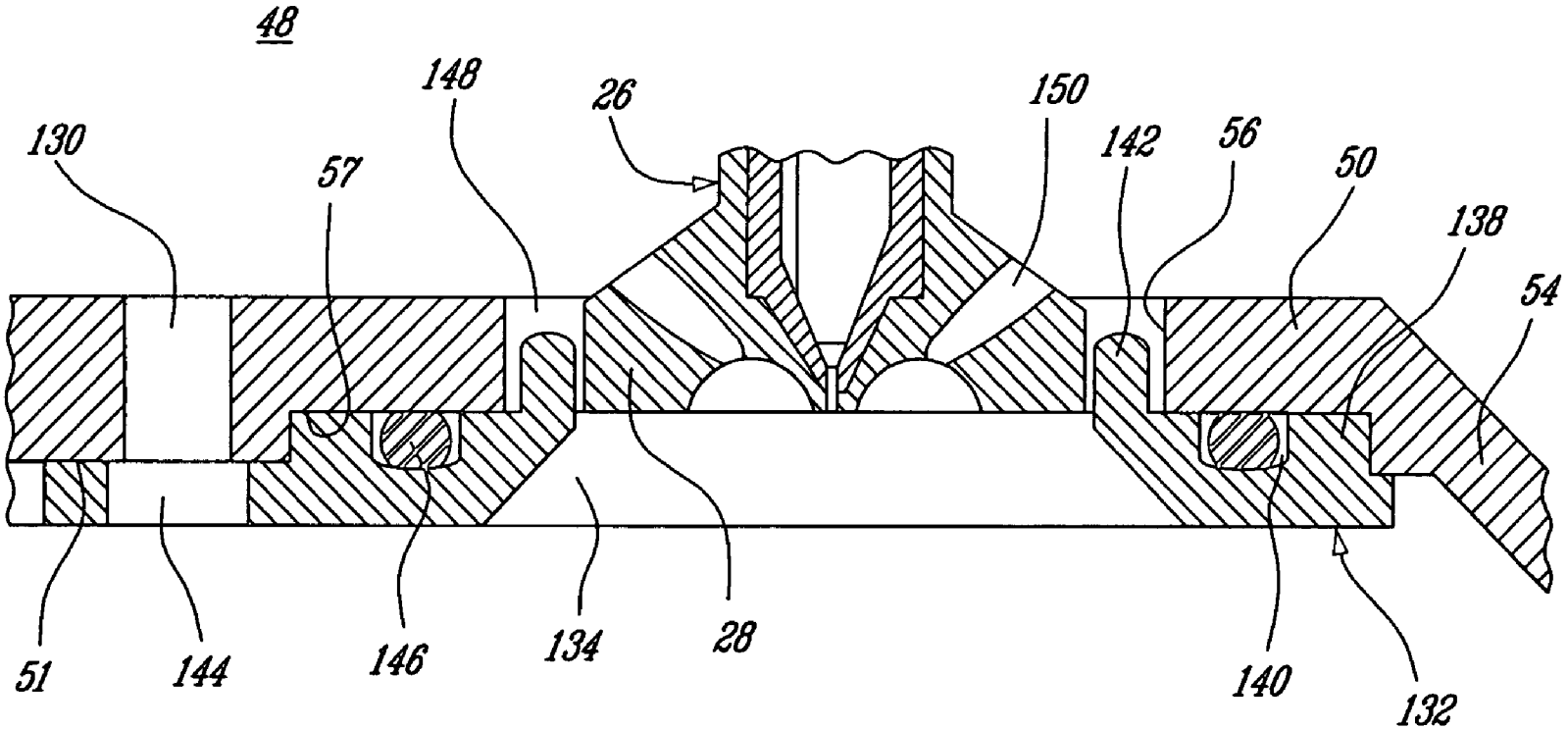
FIG. 4 is a cross-sectional view of part of the rig of FIG. 2, showing an unsealed nozzle-receiving hole receiving a fuel nozzle to be tested.
Figure 5:
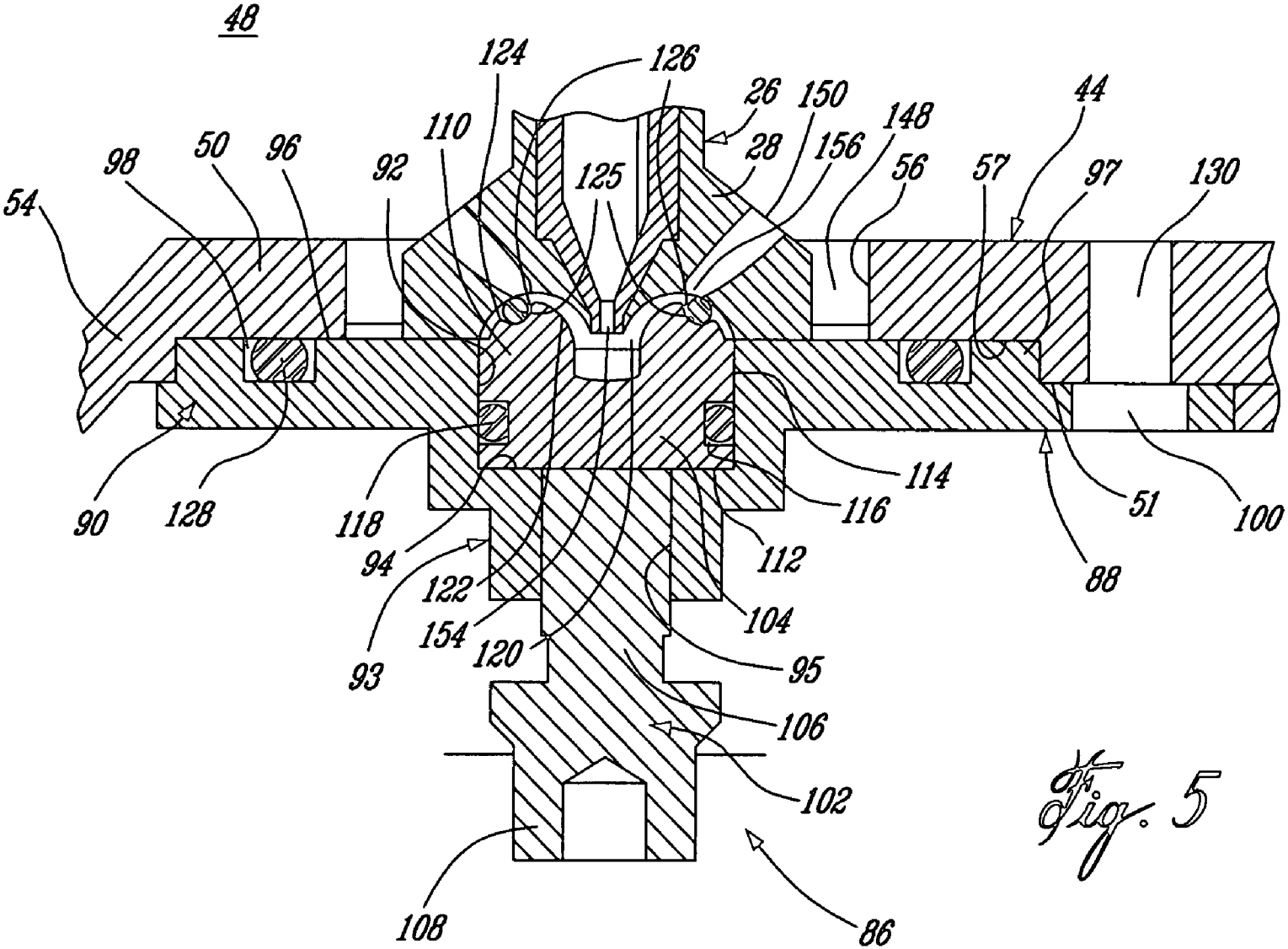
FIG. 5 is a cross-sectional view of another part of the rig of FIG. 2, showing a nozzle-receiving hole and the fuel nozzle received therein sealed by part of a sealing assembly.

The air box 32 includes opposed generally circular top and bottom walls 42, 44 interconnected by a tubular side wall 46 (omitted in FIG. 2 for improved clarity), disposed at the outer periphery of the top and bottom walls 42, 44 and defining therebetween an enclosure 48. The top wall 42 is generally planar, while the bottom wall 44 has a circular center panel 50 upwardly offset from a bottom edge 52 of the side wall 46 (see FIG. 3), and a sloping border 54 interconnecting the bottom edge 52 of the side wall 46 and the center panel 50. Referring to FIGS. 2, 4 and 5, the center panel 50 has a circular array of nozzle-receiving holes 56 defined therein in proximity of the border 54. Referring to FIGS. 4–5, a bottom surface 51 of the center panel 50 also defines a depression 57 surrounding each nozzle-receiving hole 56. The spacing and geometry of the nozzle-receiving holes 56 correspond to the spacing and geometry of the fuel nozzle 26, which are received therein as will be further detailed below.

Referring to FIGS. 2–3, the rig 30 includes two fuel inlets 58 which are each in communication with a respective channel 62 (see FIG. 3) of a fuel conduit 60 extending through the side wall 46 within the enclosure 48. Each channel 62 is adapted to be connected to a corresponding channel 61 (see FIG. 3) of a fuel inlet 63 of the fuel nozzle assembly 20. Alternately, more or less inlets 58 and channels 62 can be provided, depending on the quantity of channels 61 and inlets 63 of the fuel nozzle assembly 20.

Referring to FIG. 2, at least one support member 64 extends inwardly from the side wall 46 in the enclosure 48, each including at a free end thereof a connector 66 adapted to engage and retain a respective one of the lugs 24 of the fuel nozzle assembly 20.

Referring to FIG. 3, the rig 30 further comprises a hollow shaft 68 supporting the air box 32 and extending upwardly from the top wall 42, with a central axis thereof coincident with a central axis 70 of the air box 32. The hollow shaft 68 defines therein an air conduit 72 which is in communication with the enclosure 48. The hollow shaft 68 also includes at a top end 73 thereof an air inlet 74 in communication with the air conduit 72, and adapted to be connected to an appropriate source of compressed air (not shown) such as to circulate compressed air within the enclosure 48.

The shaft 68 is rotationally received inside the sleeve 38, such as for example through a bearing mechanism 76 sandwiched therebetween. The top end 73 of the shaft 68 extends above the sleeve 38, and a nut 78 is engaged around the top end 73 over the sleeve 38 in order to prevent the shaft 68 from sliding downwardly out of the sleeve 38.

Referring to FIG. 2-3, an indexing member 80 extends from the top wall 42 in proximity of the shaft 68. The indexing member 80 includes a pin supporting member 82 extending from the top wall 42, supporting a pin 84 (see FIG. 3) such that the pin 84 is slidable in a plane substantially parallel to the top wall 42 along a radial direction thereof. The pin 84 is slidable between an engaged position, where the pin 84 engages a selected one of the pin holes 40 defined in the sleeve 38 to prevent the air box 32 from rotating, and a free position, where the pin 84 is slid out of the pin hole 40 to allow rotation of the air box 32. The pin 84 can be biased in the engaged position by suitable biasing means (not shown), such as for example a spring. The angular spacing between the pin holes 40 is the same as, or a factor of, the angular spacing between the nozzle-receiving holes 56, such that by engagement of the pin 84 with the appropriate pin hole 40, any one of the nozzle-receiving holes 56 can be located over a fixed flow measurement apparatus, as will be further detailed below.

Referring to FIG. 3, a flow impeding assembly, such as a flow sealing 86, is provided which at least blocks all but a selected number of fuel nozzles within the rig, for testing of the unblocked selected number of fuel nozzles. The flow sealing assembly 86 comprises a plurality of sealing covers 88 which seal all but a selected number (such as, for example, one, two, three, etc.) of the nozzle-receiving holes 56, such as to prevent fluid (whether air, fuel, an alternate testing fluid or a mixture thereof, for example) from exiting from the sealed fuel nozzles. The flow impeding assembly may also merely block all but the selected number of fuel nozzles (i.e. the flow impeding assembly does not necessarily seal, but at least blocks the fluid (such a fuel) flowing through the remaining fuel nozzles such as to impede, redirect or otherwise prevent the fluid from the "blocked" nozzles to interfere with the sprayed fluid ejection and determination of at least one spray characteristic of the selected number of "unblocked" nozzle(s) using one or more flow measurement apparatus. Although in the embodiment described in further detail below, the flow impeding assembly is a sealing assembly which actively seals the spray tips of the covered fuel nozzles, it is to be understood that the flow impeding assembly can also merely block fluid flow out of these fuel nozzles and therefore need to provide a tight seal thereagainst. Also, although fuel and air may be provided to the fuel nozzle assembly for testing thereof using the present method and testing rig, it is to be understood that any suitable testing fluid can also be used, either alone or in combination with another suitable fluid (e.g. fuel only, fuel and air, fuel/air mixture, air only, etc.).

Referring to FIG. 5, one of the sealing covers 88 of the flow sealing assembly 86 is shown. Each sealing cover 88 includes a cover member 90 having a cylindrical receiving aperture 92 defined therethrough and a rim 93 extending around the receiving aperture 92. The rim 93 has an "L" shaped cross-section and extends radially inwardly around the receiving aperture 92 to define a shoulder 94 therewithin, then longitudinally away from the receiving aperture 92 to define a threaded bore 95 concentric with and having a smaller diameter than the receiving aperture 92. The cover member 90 also defines a contact surface 96 forming a protrusion 97 around the receiving aperture 92 opposite of the rim 93, the protrusion 97 being complementary to the depression 57 surrounding one of the nozzle-receiving holes 56. The relative location of the receiving aperture 92 in the protrusion 97 is such as to be concentric with the nozzle-receiving holes 56 when the protrusion 97 is engaged in the depression 57. The contact surface 96 has an annular sealing groove 98 defined therein and around the receiving aperture 92. The cover member 90 further has a plurality of attachment holes 100 (only one of which is shown) defined therethrough distributed around the receiving aperture 92.

Each sealing cover 88 also includes a nozzle sealing member 102 including a head 104 and a threaded shaft 106 having a handle member 108 connected thereto. The head 104 has a rounded tip 110, a substantially flat bottom surface 112 and a cylindrical side surface 114 extending between the bottom surface 112 and the tip 110. An annular sealing groove 116 is defined in the side surface 114 around the head 104. The nozzle sealing member 102 is engaged with the cover member 90 by placing the head 104 in the receiving aperture 92 with the bottom surface 112 adjacent the shoulder 94 and the head tip 110 protruding from the contact surface 96, and threading the shaft 106 into the bore 95 to push against the bottom surface 112 of the head 104. A seal 118 is received within the groove 116 to provide a sealed connection between the nozzle sealing member 102 and the cover member 90. Rotation of the shaft 106 within the bore 95 allows adjustment of the protrusion of the head tip 110 from the contact surface 96.

The shape of the head tip 110 is complementary to the shape of one of the fuel nozzle spray tips 28 of the fuel nozzle assembly 20, and as such in the embodiment shown the rounded tip 110 includes a hollow center 120 bordered by an annular ridge 122, which is separated from an annular lip 124 by an annular groove 126, which receives a seal 125

(such as an o-ring seal, for example) for the purpose of sealing the fuel passage while minimizing damage to tip 28. Any alternate head geometry adapted to a specific type of fuel nozzles 26 being tested are also considered. Since the nozzle sealing member 102 can be detached from the cover member 90, different nozzle sealing members 102 can be alternately combined with a same cover member 90 depending on the geometry of the fuel nozzles 26 being tested. Alternately, the cover member 90 and nozzle sealing member 102 can be integrally manufactured to define a one-piece sealing cover 88.

Still referring to FIG. 5, each sealing cover 88 is connected to the bottom wall 44 over a corresponding one of the nozzle-receiving holes 56, with the protrusion 97 of the contact surface 96 of the cover member 90 mated in the depression 57 defined around the corresponding nozzle-receiving hole 56, and with the tip 110 of the nozzle sealing member 102 extending in the corresponding nozzle-receiving hole 56. A seal 128 is received in the groove 98 of the cover member 90 around the nozzle-receiving hole 56 to provide a sealed connection. The sealing cover 88 is detachably connected to the bottom wall 44 through suitable fasteners (not shown), such as for example bolts, extending through the attachment holes 100 and corresponding holes 130 (see also FIG. 2) defined in the bottom wall 44.

Referring to FIG. 4, the rig 30 also includes a guiding member 132 having a frustro-conical guiding aperture 134 defined therethrough. The guiding member 132 defines a contact surface 136 forming a protrusion 138 around the guiding aperture 134, the protrusion 138 being complementary to the depression 57 surrounding one of the nozzle-receiving holes 56. The relative location of the guiding aperture 134 in the protrusion 138 is such as to be concentric with the nozzle-receiving holes 56 when the protrusion 138 is engaged in the depression 57. The contact surface 136 has an annular sealing groove 140 defined therein around the guiding aperture 134, and an annular rim 142 protruding from the contact surface 136 and bordering the guiding aperture 134 around its smallest diameter. The guiding member 132 further has a plurality of attachment holes 144 defined therethrough (only one of which is shown) distributed around the guiding aperture 134. The guiding member 132 is connected to the bottom wall 44 with the rim 142 protruding through the nozzle-receiving hole 56 not covered by the sealing assembly 86, the rim 142 surrounding the corresponding spray tip 28 and the guiding aperture 134 forming a frustro-conical outlet extending around the spray tip 28. A seal 146 is received in the groove 140 to provide a sealed connection between the guiding member 132 and the bottom wall 44. The guiding member 132 is detachably connected to the bottom wall 44 using the same type of fasteners (not shown) as the sealing covers 88, through the attachment holes 144 and the same bottom wall holes 130 used to attach the sealing covers 88. As such the sealing covers 88 and guiding member 132 are easily interchangeable.

In a particular embodiment, the air box 32, sealing assembly 86 and guiding member 132 are made of aluminium, but other appropriate materials may alternately be used.

In use, and referring to FIG. 2, the fuel nozzle assembly 20 is received within the enclosure 48 of the air box 32. Referring to FIGS. 4–5, the spray tip 28 of each one of the fuel nozzles 26 is received in a corresponding one of the nozzle-receiving holes 56. Each spray tip 28 is located in the respective nozzle-receiving hole 56 such as to leave an annular free space 148 around the spray tip 28, and with air inlets 150 thereof in fluid communication with the enclosure 48. Referring back to FIG. 2, the support members 64 of the rig 30 are engaged to respective ones of the lugs 24 of the fuel nozzle assembly 20, and the fuel conduit 60 is connected to the fuel inlet 63 of the manifold 22.

Referring to FIG. 5, each but one of the nozzle-receiving holes 56 is sealed by the sealing assembly 86 by engaging the cover member 90 of the respective sealing cover 88 to the bottom wall 44 thereover. The tip 110 of each nozzle sealing member 102 engages the corresponding nozzle spray tip 28 through contact of the seal 125 with the spray tip 28 around fuel and air outlets 154, 156 thereof. The shaft 106 of each nozzle sealing member 102 is rotated within the bore 95 of the respective cover member 90 to adjust the height of the head 104 within the nozzle-receiving hole 56, such as to have a sealing engagement between the seal 125 and the spray tip 28. Each sealing cover 88, through the engagement of the nozzle sealing member 102 with the spray tip 28 and the sealing action of the different seals 125, 118, 128, prevents air and fuel from exiting from the corresponding spray tip 28. As contact between the sealing assembly 86 and the fuel nozzle spray tips 28 is limited, risks of plugging or damaging the spray tips 28 with the rig 30 are minimized.

Thus, a single nozzle-receiving hole 56 is left uncovered by the sealing assembly 86, thus leaving the fuel nozzle 26 contained therein unsealed. Referring to FIG. 4, the guiding member 132 is connected to the bottom wall 44 around that remaining nozzle-receiving hole 56 to define a frustro-conical outlet extending around the spray tip 28 of the fuel nozzle 26 received therein. The frustro-conical outlet is adapted to guide a fuel and air flow exiting from the spray tip 28. Alternately, the guiding member 132 can be omitted, especially in cases where such guidance is either not required or provided by the geometry of the nozzle-receiving holes 56.

Referring to FIGS. 2–3, the air box 32 is rotated about the sleeve 38 until the unsealed nozzle-receiving hole 56 is aligned with an appropriate flow measurement apparatus (schematically indicated at 152 in FIG. 3), such that the fuel nozzle 26 located in the unsealed nozzle-receiving hole 56 is in operating relationship therewith. The flow measurement apparatus 152 can be any appropriate type of apparatus allowing the observation of one or more of the spray characteristics of the unsealed fuel nozzle 26, including, but not limited to, a "catch and weigh" device or an "optical patternation" device for example. Optical patternation techniques such as those described in commonly owned U.S. patent application Ser. No. 11/386,940 entitled "Calibration of Optical Patternation Spray Parameter Measurements" and U.S. patent application Ser. No. 11/386,941 entitled "Method of Computing Spray Parameters from Optical Patternation", both filed on Mar. 23, 2006, may be used by the flow measurement apparatus 152, and the entire specifications of these two co-pending patent applications are incorporated by reference herein. The pin 84 (see FIG. 3) is slid into the aligned pin hole 40 to prevent further rotation of the air box 32.

The air and fuel inlets 58, 74 of the air box 32 are respectively connected to compressed air and fuel sources (not shown). Fuel is circulated from the fuel source to the manifold 22 through the rig fuel inlets 58, rig fuel conduit 60, and manifold fuel inlets 63. Air is circulated from the air source to the enclosure 48 through the air inlet 74 and air conduit 72. The fuel nozzle 26 located in the unsealed nozzle-receiving hole 56 is thus operated, drawing fuel from the manifold 22 and air from the enclosure 48, and its flow is analyzed using the flow measurement apparatus 152.

Meanwhile, the flow out of the remaining fuel nozzles 26 is blocked by the sealing assembly 86.

When the flow of the unsealed fuel nozzle 26 has been analyzed, operation of the unsealed fuel nozzle 26 is stopped. The configuration of the sealing assembly 86 is changed by detaching one of the sealing covers 88 from the bottom wall 44, thus unsealing another nozzle-receiving hole 56. The guiding member 132 is also detached from the bottom wall 44, and the corresponding nozzle-receiving hole 56 is covered with the newly removed sealing cover 88. The guiding member 132 is engaged over the new unsealed nozzle-receiving hole 56. The pin 84 is slid out of engagement with the pin hole 40, and the air box 32 is rotated until the newly unsealed nozzle-receiving hole 56 is aligned with the flow measurement apparatus 152, such that the respective fuel nozzle 26 is in operating relationship therewith. The pin 84 is slid into the new aligned pin hole 40 to prevent further rotation of the air box 32. Analysis of the flow of the new unsealed fuel nozzle 26 is then performed as described above.

Thus, the flow of every fuel nozzle 26 of the fuel nozzle assembly 20 can be analyzed independently, without interference from the remaining fuel nozzles 26. The air box 32 is rotated between each analysis such as to successively bring every fuel nozzle 26 in alignment with the flow measurement apparatus 152. The configuration of the sealing assembly 86 is changed such as to uncover the fuel nozzle 26 being analyzed while sealing the remaining fuel nozzles 26.

The rig 30 can thus be used to perform pattern tests for the individual fuel nozzles 26 in order to determine the spray characteristics of each nozzle 26 separately (e.g. fuel zonal distribution, tip flow number, swirler effective area) while avoiding interference from adjacent fuel nozzles 26. If desired, simultaneous tests of two or more nozzles 26 can still be performed by removing the corresponding sealing covers 88 and replacing them with guiding member 132.

The above description is meant to be exemplary only, and one skilled in the art will recognize that changes may be made to the embodiments described without department from the scope of the invention disclosed. For example, the sealing assembly 86 can be of unitary construction, with the sealing covers 88 being either permanently or detachably connected to one another. Also, the shape and configuration of the air box 32, as well as the shape and configuration of the nozzle sealing members 102, can be varied in accordance with the geometry of the tested fuel nozzle assembly 20. Moreover, the air box 32 can be indexed through movement other than a rotational motion about its central axis 70, for example through a translational motion within a plane defined parallel to the top wall 42. Appropriate driving means can be provided to assist the movement of the air box 32. Still other modifications which fall within the scope of the present invention will be apparent to those skilled in the art, in light of a review of this disclosure, and such modifications are intended to fall within the appended claims.

What is claimed is:

1. A method for testing a fuel nozzle assembly including a plurality of spaced apart fuel nozzles in communication with a manifold, the method comprising:

supporting the fuel nozzle assembly with a rig;

blocking all but a selected number of the fuel nozzles with a flow impeding assembly;

moving part of the rig to align the selected number of the fuel nozzles with at least one flow measurement apparatus; and operating the fuel nozzle assembly and determining at least one spray characteristic of the selected number of the fuel nozzles using the flow measurement apparatus.

2. The method as defined in claim 1, wherein after operating the selected number of the fuel nozzles, the method comprises:

changing a configuration of the flow impeding assembly to block all but at least one different fuel nozzle;

moving the part of the rig to align the at least one different fuel nozzle with the flow measurement apparatus; and operating the fuel nozzle assembly and determining at least one spray characteristic of the at least one different fuel nozzle using the flow measurement apparatus.

3. The method as defined in claim 1, wherein the step of moving the part of the rig includes rotating the part of the rig about a central axis thereof.

4. The method as defined in claim 1, wherein the part of the rig defines an enclosure receiving the fuel nozzle assembly therein with the fuel nozzles protruding therefrom, and the step of blocking includes detachably connecting the flow impeding assembly to the part of the rig in a selected one of a plurality of positions to block all but the selected number of the fuel nozzles.

5. The method as defined in claim 4, wherein the flow impeding assembly includes a plurality of sealing covers, and the step of blocking includes detachably connecting a respective sealing cover to the part of the rig in sealing engagement with a spray tip of each but the selected number of the fuel nozzles.

6. The method as defined in claim 1, further comprising, before operating the selected number of the fuel nozzles, a step of installing a flow guiding member around the selected number of the fuel nozzles.

7. The method as defined in claim 1, wherein the flow impeding assembly includes a sealing assembly, and the step of blocking includes sealing all but the selected number of the fuel nozzles using the sealing assembly such as to prevent fluid from exiting therefrom.

8. The method as defined in claim 1, wherein the step of blocking comprises blocking all but a selected one of the fuel nozzles with the flow impeding assembly.

9. A fuel nozzle assembly testing rig for testing a fuel nozzle assembly comprising:

a receiving member defining an enclosure and having a wall with an array of spaced apart nozzle-receiving holes defined therethrough in communication with the enclosure;

at least one fluid conduit in communication with the enclosure and adapted to be connected in fluid flow communication with the fuel nozzle assembly; and a flow impeding assembly detachably connected to the receiving member in a selected one of a plurality of configurations, each of the configurations leaving at least one of the nozzle-receiving holes unobstructed while blocking the remaining nozzle-receiving holes.

10. The testing rig as defined in claim 9, wherein the flow impeding assembly includes a sealing assembly having a nozzle sealing member engaged within each of the remaining nozzle-receiving holes.

11. The testing rig as defined in claim 10, wherein each nozzle sealing member is detachably connected to a remainder of the sealing assembly.

12. The testing rig as defined in claim 9, wherein the receiving member is movably connected to a support such as to move relative thereto between a plurality of positions, a respective one of the nozzle-receiving holes being aligned with a same fixed point for each of the positions.

13. The testing rig as defined in claim 12, wherein the receiving member is moveable between the plurality of positions through a rotation about a central axis thereof.

14. The testing rig as defined in claim 9, further comprising a guiding member detachably connected to the receiving member and forming a guiding outlet surrounding the at least one unobstructed nozzle-receiving hole.

15. The testing rig as defined in claim 9, wherein the receiving member is an air box having at least one air conduit in fluid flow communication between the air box and an air source.

16. The testing rig as defined in claim 15, wherein the at least one fluid conduit is a fuel conduit in fluid flow communication with the air box, the fuel conduit being in fluid flow communication with a fuel source.

17. A fuel nozzle assembly testing rig for testing a fuel nozzle assembly including a manifold and a series of regularly spaced apart fuel nozzles connected thereto, the testing rig comprising:

a receiving member supporting and moving the fuel nozzle assembly to successively align each of the fuel nozzles with a flow measurement apparatus;

at least one fluid conduit in operating engagement with the fuel nozzle assembly for providing a testing fluid thereto; and means for blocking all but at least one unobstructed fuel nozzle, the means for blocking being configurable in a selected one of a plurality of configurations, each of the configurations providing different fuel nozzles as the at least one unobstructed fuel nozzle.

18. The testing rig as defined in claim 17, wherein the means for blocking includes a means for sealing all but the at least one unobstructed fuel nozzle.

19. The testing rig as defined in claim 18, wherein the means for sealing is detachably connected to the receiving member to seal all but the at least one unobstructed fuel nozzle.

20. The testing rig as defined in claim 17, wherein the receiving member includes an air box receiving the fuel nozzle assembly therein, the air box being movably connected to a support to be movable between a plurality of positions, each of the positions corresponding to a different one of the at least one unobstructed fuel nozzle being aligned with the flow measurement apparatus.

21. The testing rig as defined in claim 20, wherein the airbox is rotationally connected to the support to rotate between the positions.

22. The testing rig as defined in claim 19, wherein the means for sealing includes a sealing assembly detachably connected to the receiving member in the selected one of the plurality of configurations.

23. The testing rig as defined in claim 17, further comprising means for guiding a flow produced by the at least one unobstructed fuel nozzle.

* * * * *